US006154228A

United States Patent [19]

Okuda et al.

[11] Patent Number: 6,154,228

[45] Date of Patent: Nov. 28, 2000

[54] IMAGE RECORDING DEVICE CAPABLE OF PREVENTING DEVIATION OF INK DOT ON RECORDING MEDIUM

[75] Inventors: Masakazu Okuda; Fuminori Takizawa; Yasuhiro Otsuka; Torahiko Kanda, all of Tokyo, Japan

[73] Assignee: NEC Corporation, Tokyo, Japan

[21] Appl. No.: 09/135,407

[22] Filed: Aug. 18, 1998

[30] Foreign Application Priority Data

Aug. 18, 1997 [JP] Japan ..... 9-220557

[51] Int. Cl.[7] ..... B41J 2/205

[52] U.S. Cl. ..... 347/15; 347/9; 347/10; 347/14

[58] Field of Search ..... 347/9–11, 14, 347/15

[56] References Cited

U.S. PATENT DOCUMENTS 5,689,291 11/1997 Tence et al. ..... 347/10
5,764,252 6/1998 Burr et al. ..... 347/20
5,933,168 8/1999 Sakai ..... 347/70

FOREIGN PATENT DOCUMENTS 3-173654 7/1991 Japan .
9-57963 3/1997 Japan .

*Primary Examiner*—John Barlow
*Assistant Examiner*—Craig A. Hallacher
*Attorney, Agent, or Firm*—Foley & Lardner

[57] ABSTRACT

In an image recording device which records an image on a recording medium responsive to a desired gradation in each pixel and which includes a recording head for jetting an ink droplet having a diameter at a speed therefrom, the diameter of the ink droplet is modulated in response to the desired gradation in each pixel while the speed is modulated dependent on the modulated diameter. Thus, a position of impact of the ink droplet is not deviated, so that quality of image is not deteriorated.

7 Claims, 6 Drawing Sheets

IMAGE RECORDING DEVICE CAPABLE OF PREVENTING DEVIATION OF INK DOT ON RECORDING MEDIUM

BACKGROUND OF THE INVENTION

The present invention relates to an image recording device which is applied to a printer, a facsimile machine, a copying machine, and the like, particularly to an ink jet type image recording device which carries out image recording by jetting a hyperfine ink droplet on a recording medium.

Conventionally, an image recording device is generally applied to a printer, a facsimile machine, a copying machine, and the like. As a method of recording image in such an image recording device, several types of the methods, such as an electrophotographic type, an ink jet type, a thermoelectric type, and the like thereof have been put into practical use. Among these types of the methods, the ink jet type has an advantageous feature that enables downsizing the device, low cost fabrication, and color image recording. As a result, it is a recent trend that the ink jet type image recording device is mainly used as a color image recording device in personnel use.

As will later be described more in detail, a conventional color ink jet recording device includes a plurality of recording heads each jetting a respective color ink droplet. As a principle for jetting the ink droplet from each recording head, several systems, such as a system using a piezoelectric actuator, a system using a boiling phenomenon of ink, a system using an electrostatic absorption of ink, or the like, are proposed and practically used.

In the interim, it has currently been a big theme to improve quality of image in the aforesaid ink jet recording device. In other words, a conventional ink jet recording device has already reached the practical limit of recording resolution thereof [for example, approximately 600 through 1200 dpi (dot per inch)]. In addition, a diameter of every ink droplet is generally kept constant in the conventional ink jet recording device. As a result, it is difficult to freely control gradation in each pixel of the conventional ink jet recording device. Accordingly, the conventional ink jet recording device has also reached a certain limit in image quality of output image thereof. A sufficient quality of image cannot be obtained, when a pictorial image is output by the conventional ink jet recording device.

As a method for improving the above-mentioned quality of image, a large number of consideration is made about a method of gradually recording image for varying gradation in each pixel by controlling the diameter of every ink droplet jetted onto the recording medium. Several methods are proposed to modulate a diameter of every ink droplet in the ink jet recording device. An example is disclosed in Unexamined Japanese Patent Publication No. 173654/1991. In the example disclosed therein, a diameter of every ink droplet jetted from a recording head using a boiling phenomenon of ink is modulated by varying an input energy supplied to a heating element provided in the recording head. Further, another example is disclosed in Unexamined Japanese Patent Publication 173654/1991. The another example is an ink droplet jetting device which uses a surface wave interference and is advantageous in modulating a diameter of an ink droplet. Thus, it becomes possible that gradation in each pixel is controlled to record gradual image therein by modulating a diameter of an ink droplet.

However, it is known that reduction of sharpness of image or deterioration of color reproduction is easily caused to occur in the above-described conventional devices. These problems have been confirmed by the inventor of the present invention, et al as the result of actually recording the modulation in the conventional devices. Accordingly, it becomes clear that high quality of image cannot be obtained up to their expectation by the conventional devices.

The inventor has inspected a reason of the problems. As a result, it becomes clear that a ballistic path of an ink droplet jetted from the recording head in the conventional devices varies dependent on a diameter of the ink droplet, so that deviation of points of impact of ink droplets on a recording medium is inevitably caused to occur. This is clearly a main reason why quality of image is deteriorated in the conventional devices. Namely, an ink droplet jetted from the recording head flies under the influence of air flow or air resistance between the recording head and a recording medium. The influence depends largely upon the diameter of the ink droplet. Consequently, the aforesaid ballistic path of the ink droplet largely varies dependent on the diameter of the ink droplet. Thereby, large deviation of points of impact of ink droplets on the recording medium is inevitably caused to occur. In the above-mentioned conventional devices, jetting speed of the ink droplet is not particularly controlled. Therefore, points of impact of ink droplets are deviated with a large error dependent upon the diameter of the ink droplet. Accordingly, it is inevitable that reduction of sharpness of image or deterioration of color reproduction is caused to occur in the above-described conventional devices.

SUMMARY OF THE INVENTION

It is therefore an object of the present invention to provide an image recording device which is capable of preventing deviation of points of impact of ink droplets on a recording medium, even though diameters of the ink droplets are modulated for recording a gradual image.

Other objects of the present invention will become clear as the description proceeds.

On describing the gist of the present invention, it is readily understood that an image recording device records an image on a recording medium responsive to a desired gradation in each pixel.

According to an aspect of the present invention, there is provided an image recording device comprising: a recording head for jetting an ink droplet having a diameter at a speed therefrom; diameter modulating means for modulating the diameter of the ink droplet in response to the desired gradation in each pixel; and speed modulating means for modulating the speed dependent on the diameter of the ink droplet.

The image recording device may further comprise control means for controlling each operation of the diameter modulating means and the speed modulating means, wherein the diameter and the speed are managed and arranged by the control means.

The image recording device may comprise pulse generating means for generating a pulse which drives the recording head to jet the ink droplet, wherein the pulse generating means are operable as both the diameter modulating means and the speed modulating means.

The diameter may comprise a first diameter and a second diameter smaller than the first diameter, the speed may comprise a first speed and a second speed lower than the first speed, the speed being determined to be the first speed or the second speed when the diameter is determined to be the first diameter or the second diameter, respectively.

The diameter may be modulated by a pulse width modulation of the pulse generated from the pulse generating means.

The speed may be modulated by a pulse amplitude modulation of the pulse generated from the pulse generating means.

The diameter may be modulated by a pulse width modulation of the pulse while the speed is modulated by a pulse amplitude modulation thereof.

According to another aspect of the present invention, there is provided an image recording device comprising: a recording head for jetting an ink droplet having a diameter at a timing therefrom; diameter modulating means for modulating the diameter of the ink droplet in response to the desired gradation in each pixel; and timing modulating means for modulating the timing dependent on the diameter of the ink droplet.

The image recording device may further comprise control means for controlling each operation of the diameter modulating means and the timing modulating means, wherein the diameter and the timing are managed and arranged by the control means.

The image recording device may comprise pulse generating means for generating a pulse which drives the recording head to jet the ink droplet, wherein the pulse generating means are operable as both the diameter modulating means and the timing modulating means.

The image recording device may further comprise at least two delay means which have a respective delay constant different from each other and which delays generation of the pulse to produce at least a first delayed pulse and a second delayed pulse, wherein the timing is determined by selecting one of the first delayed pulse and the second delayed pulse.

DETAILED DESCRIPTION OF THE PREFERRED EMBODIMENTS

Figure 1:
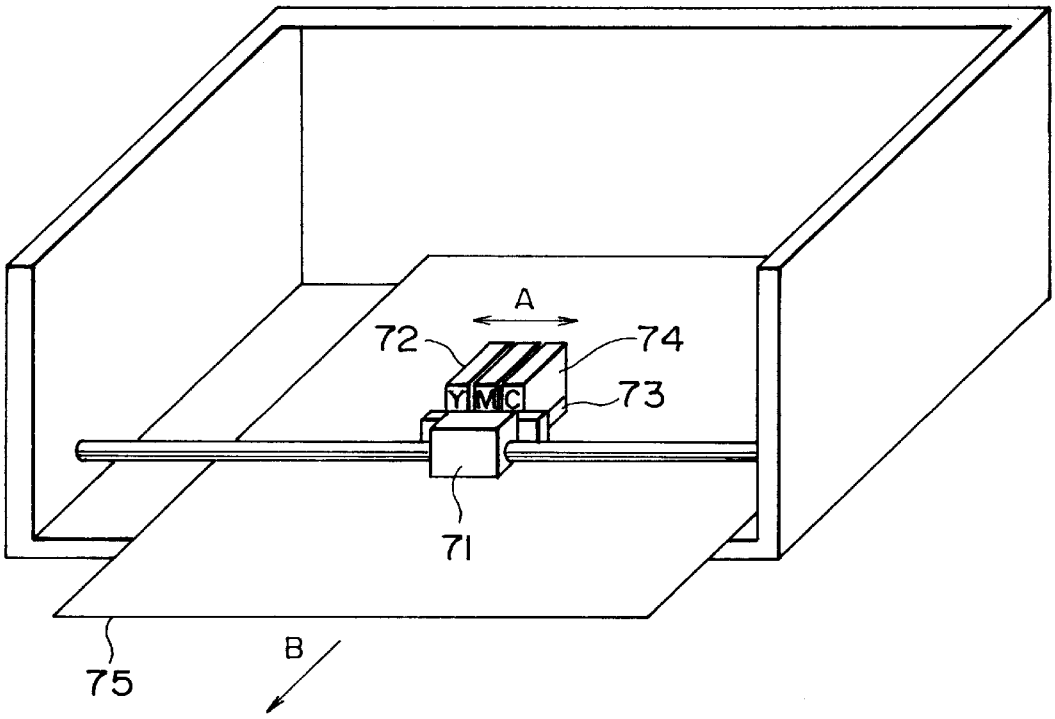
FIG. 1 PRIOR ART
FIG. 1 is a schematic perspective view for showing a conventional color ink jet recording device.

Referring to FIG. 1, description is, at first made about a conventional image recording device in order to facilitate an understanding of the present invention.

In FIG. 1, illustrated is a color ink jet recording device, as an example of the conventional image recording device.

As illustrated in FIG. 1, three recording heads 72 which are corresponding to three colors, yellow (Y), magenta (M), and cyan (C), respectively, are mounted on a carriage 71. Each recording head 72 comprises an ink droplet forming portion 73 for forming and jetting an ink droplet, and an ink tank 74. After carrying out color resolution of output image and various data processing, a printer driver (not shown) supplies a driving signal of each color to each corresponding recording head 72. In response to each driving signal, each recording head 72 jets an ink droplet of each color toward a recording sheet 75. In the interim, the three recording heads 72 are moved or scanned by the carriage 71 in the width direction of the recording sheet 75, as depicted by an arrow A in FIG. 1. Synchronized with the scanning operation by the carriage 71, the recording sheet 75 is brought in the length direction thereof, as depicted by an arrow B in FIG. 1. Thus, recording operation is performed over the whole area of the recording sheet 75. As a result, images of three colors, Y, M, and C are overlapped on the recording sheet 75 to form a color image.

Now, referring to FIGS. 2A, 2B, 2C, 3, 4 and 5, description will proceed to a principle of the present invention with an analysis of the problems in the conventional devices.

Herein, description is made as regards a basic principle of forming an ink droplet. As will later described, a recording head based on a principle of jetting ink which uses a surface wave interference is employed in a first embodiment of the present invention.

Figure 2A:
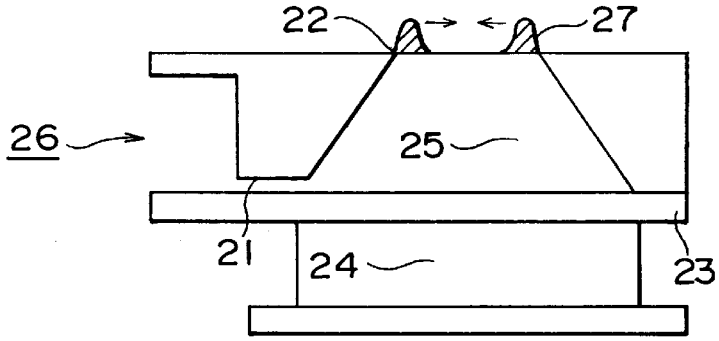
FIG. 2A PRIOR ART
FIGS. 2A through 2C are conceptual views for showing various steps of forming an ink droplet jetted from a recording head.
Figure 2B:
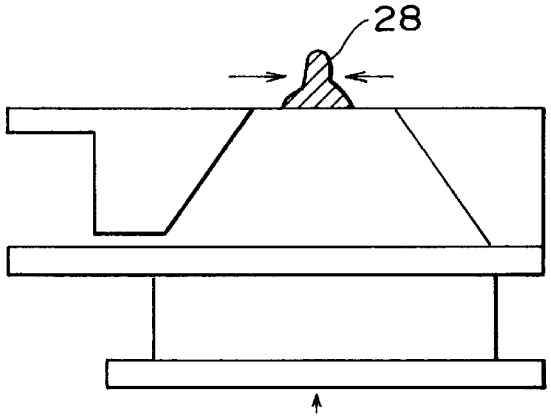
FIG. 2B PRIOR ART
Figure 2C:
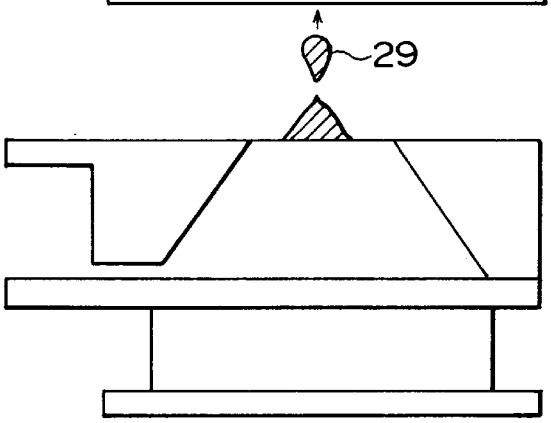
FIG. 2C PRIOR ART

In FIGS. 2A, 2B and 2C, illustrated is an ink droplet forming portion. As illustrated in FIG. 2A, the ink droplet forming portion comprises an ink flow route 21, an opened portion 22 for jetting ink, a pressing plate 23, a piezoelectric actuator 24, a pressure chamber 25, and an ink tank 26. With this structure, when the pressing plate 23 is actuated by driving the piezoelectric actuator 24 provided on a lower portion of the pressure chamber 25, a pressure of ink stored in the pressure chamber 25 is varied to produce surface waves 27 on a surface of ink within the opened portion 22 for jetting ink. As depicted by arrows in FIG. 2A, the surface waves 27 move from a circumferential portion of the opened portion 22 for jetting ink to a central portion thereof. The surface waves 27 then interfere in the central portion with each other to form a liquid pole 28 of ink, as illustrated in FIG. 2B. Further, an ink droplet 29 is made of a part of the liquid pole 28 to be jetted from the opened portion 22, as shown in FIG. 2C. Thereafter, ink is supplied by way of the ink flow route 21 from the ink tank 26 to the pressure chamber 25.

Figure 3:
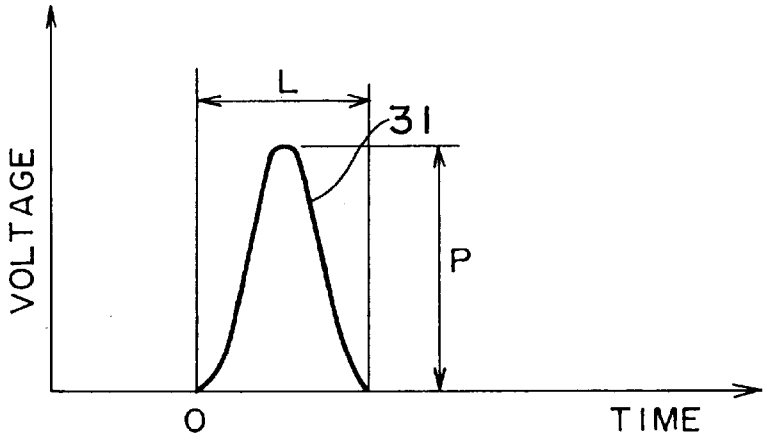
FIG. 3 is a view for showing a driving waveform which is generally applied to an image recording device.

In the above system of forming an ink droplet, it is possible to vary a diameter of the ink droplet by changing a driving waveform supplied to the piezoelectric actuator 24. Namely, when a driving pulse of sinusoidal wave form illustrated in FIG. 3 is, for example, used as the driving waveform, it is possible to vary a wavelength of the surface wave 27 illustrated in FIG. 2A by changing a pulse width L shown in FIG. 3. As a result, a diameter of the ink droplet 29 jetted from the opened portion 22, as illustrated in FIG. 2C, can be varied. An experiment was carried out by the inventor to confirm these points. As the result of the experiment, it was confirmed that a diameter of the ink droplet jetted therefrom is varied at a range between 15 μm and 50 μm by changing the pulse width L at a range between 5 μs and 30 μs. It was further confirmed that a diameter of ink dot on a recording sheet was thereby varied at a range between 23 μm and 75 μm on a condition that optical concentration in a pixel was 0.2 to 1.5.

Figure 4:
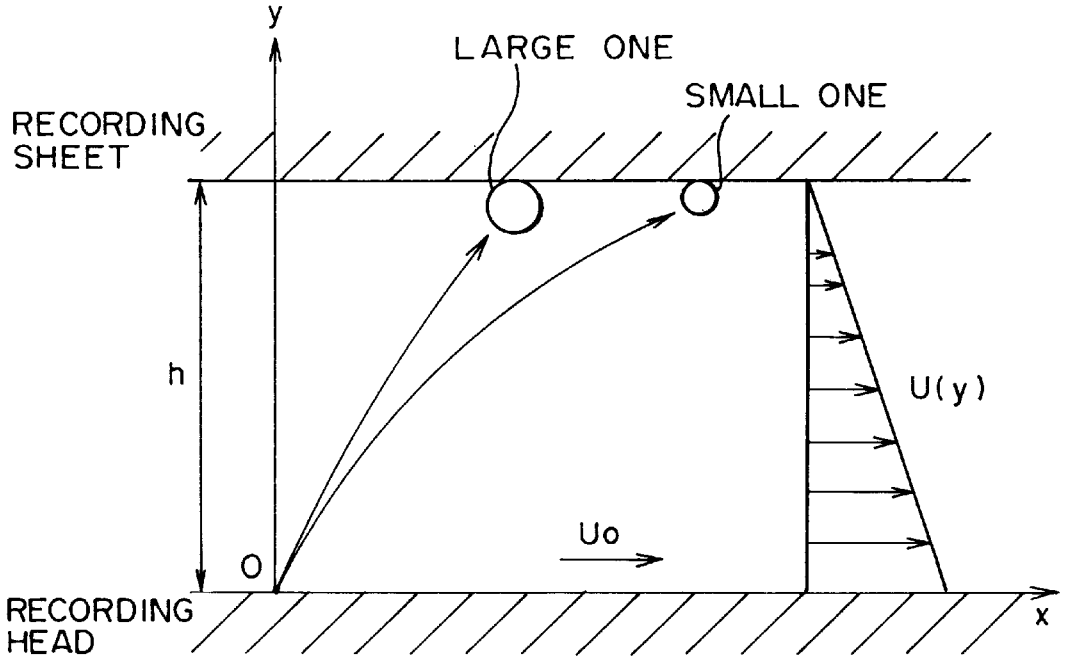
FIG. 4 is a view for conceptually showing a deviation of positions of impact of ink droplets responsive to each diameter thereof.
Figure 5:
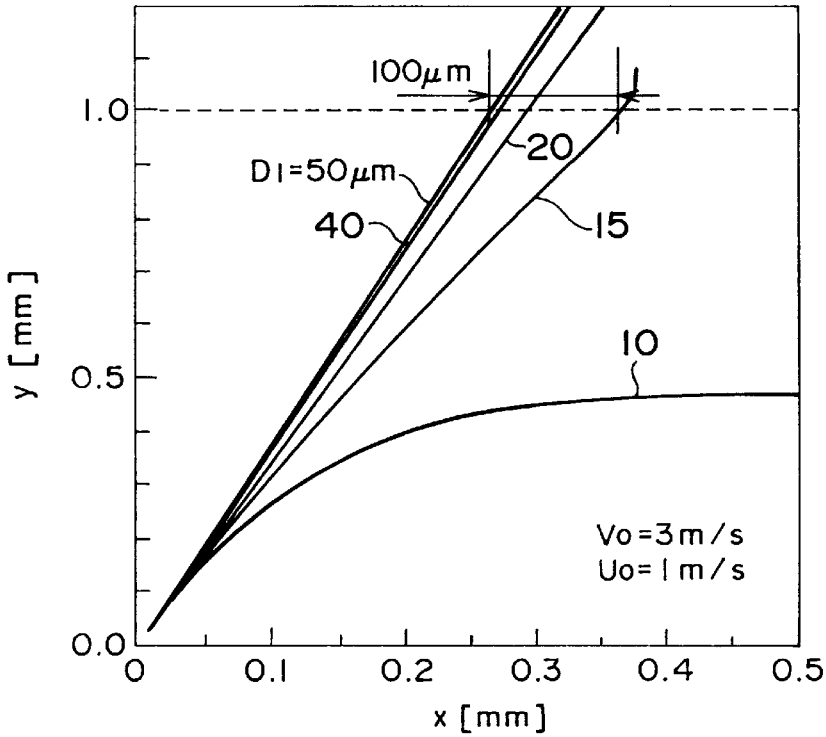
FIG. 5 is a graph for showing a result of calculation of deviation of positions of impact of the ink droplets.

Next, referring to FIGS. 4 and 5, description proceeds a result of the analysis made further in detail for the problems in the conventional devices.

FIG. 4 conceptually shows a relation between a diameter of ink droplet and a deviation of positions of impact of jetted ink droplets, in other words, a relation between the diameter and a flying distance of the ink droplet. FIG. 5 shows a result of calculation of the deviation of positions of impact of jetted ink droplets.

By the use of theoretical analysis, the inventor inspected how many extents the position of impact of the ink droplet varied by difference of a size of the diameter D1. As illustrated in FIG. 4, it is hereinafter assumed that a moving speed of a recording head is represented by U0, a distance between the recording head and a recording sheet (a flying distance of ink droplet) is represented by h. Since an air flow therebetween can be regarded as Couette flow of a laminar flow, distribution of flow rate U(y) in the y direction is represented by the following equation (1).

$$U(y)=U0\ \{1-(y/h)\} \tag{1}$$

On the other hand, air resistance D to which the ink droplet is subjected is represented by the following Stoke's equation (2).

$$D=3\pi\mu a\ v\ d \tag{2}$$

where d represents a diameter of the ink droplet, v represents a flying speed of the ink droplet, and μa represents viscosity of air ($18.2\times10^{-8}$Pa·s).

The ink droplet jetted from the recording head is gradually decelerated in the y direction by the air resistance represented by the above equation (2). On the other hand, the ink droplet flies in the x direction with a drift by the air flow represented by the above equation (1). Herein, equation of motion is depicted by the following equations (3) and (4).

$$\text{x direction: } m\ (du/dt)=-km\ \{u-U\ (y)\} \tag{3}$$

$$\text{y direction: } m\ (du/dt)=mg-kmv \tag{4}$$

where initial conditions: when t=0, x=0, y=0, u=u0, and v=v0.

In addition, k is represented by the following equation (5).

$$k=(9\mu a/2r2\rho1) \tag{5}$$

where ρ1 represents density of the ink droplets.

In FIG. 5, illustrated is a graph for showing a result of calculation for finding a locus of the ink droplet. Herein, the calculation is carried out on an assumption that the moving speed U0 of the recording head is 1 m/s and that an initial speed v0 of the ink droplet is 3 m/s. As the result of this calculation, difference of 35 μm is caused to occur between positions of impact of ink droplets having diameters 15 μm and 50 μm, respectively, when a flying distance h is 1 mm. Besides, such a deviation of the position of the impact is increased as the moving speed U0 of the recording head or the flying distance h of ink droplet becomes larger. The deviation of the position of the impact is sometimes increased furthermore, in a case that disturbance is added to the air flow between the recording head and the recording sheet. As described above, when a gradual recording is intended by modulating a diameter of an ink droplet, an error of several tens μm order is generated with respect to the position of impact of the ink droplet, dependent on the diameter thereof. Consequently, it is inevitably caused to occur that sharpness of image or color reproduction is deteriorated. It is generally required for recording high quality image that an error of the position of impact of the ink droplet falls within not larger than a half of dot pitch. Accordingly, it is necessary that the error of the position of impact is restricted to not larger than 20 μm on an assumption of the recording resolution of 600 dpi (dot per inch).

Figure 6:
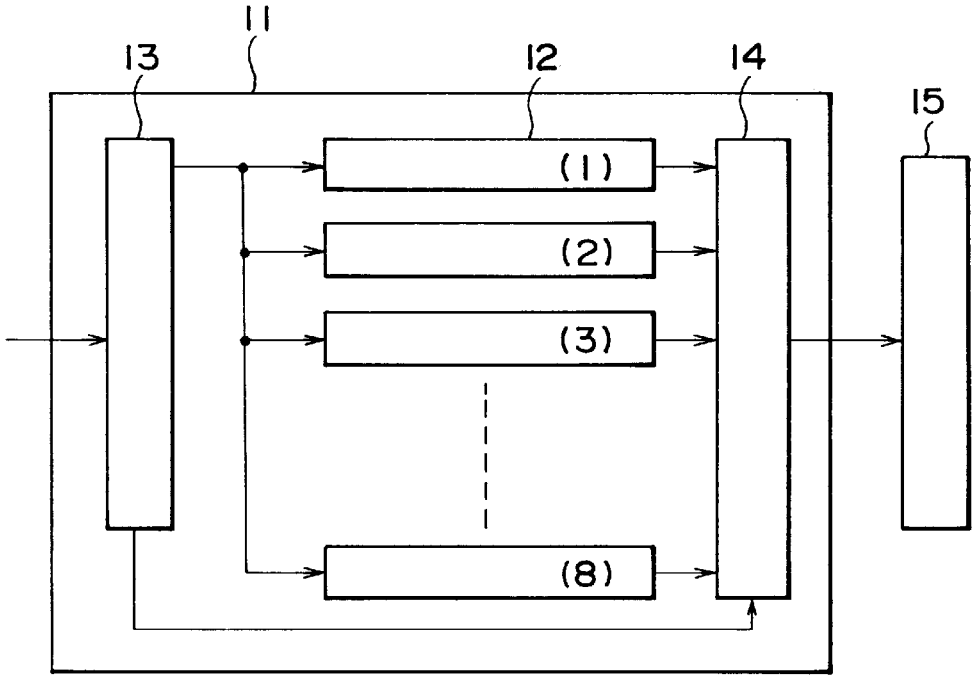
FIG. 6 is a block diagram for showing an image recording device according to a first embodiment of the present invention.
Figure 7:
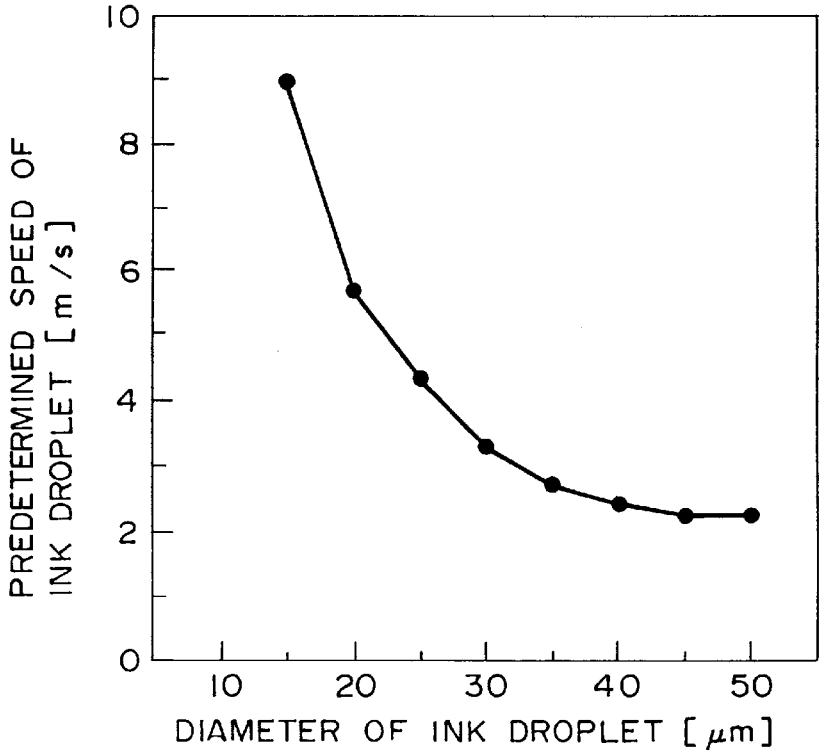
FIG. 7 is a graph for showing a relation between each diameter of the ink droplet and each predetermined speed of the ink droplet.

Referring to FIGS. 6 and 7 with reference to FIGS. 2A, 2B and 2C continued, description will proceed to an image recording device according to a first embodiment of the present invention.

In FIG. 6, an image recording device according to the first embodiment comprises a controller 11 and a recording head 15. The controller 11 comprises a waveform generating circuit group 12 consisting of waveform generating circuits (1) through (8), a control circuit 13, and a switching circuit 14.

As illustrated in FIG. 6, the waveform generating circuit group 12 consisting of eight waveform generating circuits (1) through (8) is included in the controller 11. Namely, eight kinds of driving waveforms are prepared to be supplied to the aforesaid piezoelectric actuator 24 in this embodiment. Among these eight kinds of driving waveforms, one driving waveform is selectively supplied to the piezoelectric actuator 24 in the recording head 15 by switching operation of the switching circuit 14. A single sinusoidal pulse shown in FIG. 3 is used as the driving waveform also in this embodiment. The diameter of ink droplet is varied by eight grades at a range between 15 μm and 50 μm by the use of eight kinds of the driving waveforms each having a pulse width L different from each other. Thus, gradation in a pixel can be varied at a wide range by modulating the diameter of ink droplet. In principle, very high quality of image can be obtained, when a pictorial image is output by the image recording device of this embodiment. An essential feature of this embodiment is to control and optimize a speed of a jetted ink droplet responsive to the diameter of the ink droplet.

FIG. 7 shows each value of a speed of an ink droplet responsive to each diameter of the ink droplet. As readily understood from FIG. 7, when the diameter becomes smaller, the ink droplet is controlled to be jetted from the recording head at a larger speed. The speed of the ink droplet is controlled by a pulse amplitude modulation of the aforesaid driving waveform. When the sinusoidal waveform shown in FIG. 3 is used as the driving waveform, the diameter of the ink droplet is mainly determined by the pulse width L. On the other hand, the speed of the ink droplet is mainly determined by the pulse amplitude P. It therefore becomes possible that the speed of the ink droplet is freely determined by modulating the pulse amplitude P. Namely, in the first embodiment of the present invention, the circuit group 12 consisting of waveform generating circuits (1) through (8) is operable as both a diameter modulating unit for modulating the diameter of the ink droplet and a speed modulating unit for modulating the speed of the ink droplet. The pulse amplitude P is determined to have values different from each other at a range between 20 V and 40 V with respect to the aforesaid eight driving waveforms. Thereby, a relation shown in FIG. 7 between each diameter of the ink droplet and each speed thereof is achieved.

An experiment was performed to estimate an actual image recording by the image recording device of the first embodiment. As a result, it was estimated that deviation of position of impact of ink droplet fell within 18 μm between the smallest diameter of the ink droplet (15 μm) and the largest diameter thereof (50 μm). Also in an actual output image, the image recording device of the first embodiment did not bring about deterioration of sharpness of image or color reproduction which is caused by the above-mentioned conventional devices. Thus, it was confirmed that high quality image could be output by the image recording device of the first embodiment.

Figure 8:
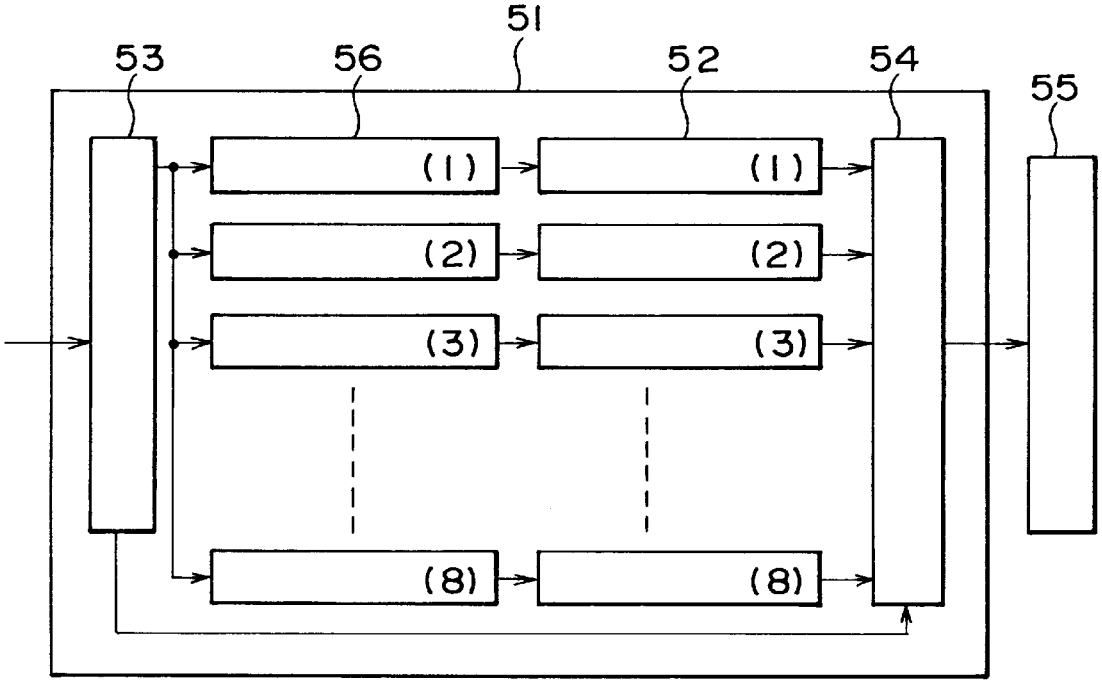
FIG. 8 is a block diagram for showing an image recording device according to a second embodiment of the present invention.
Figure 9:
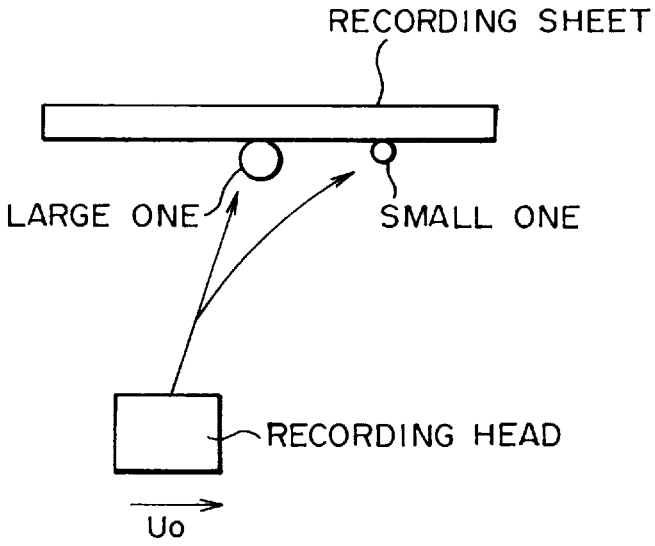
FIG. 9 is a view for conceptually showing a case in which positions of impact of ink droplets are deviated between a comparatively large one and a comparatively small one.
Figure 10:
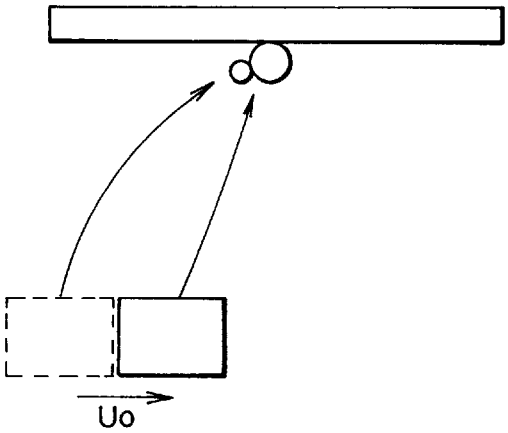
FIG. 10 is a view for conceptually showing another case in which positions of impact of ink droplets are not deviated between the comparatively large one and the comparatively small one by changing a timing for jetting the ink droplets therebetween.

Referring to FIGS. 8 through 10, description will proceed to an image recording device according to a second embodiment of the present invention. Also in the second embodiment, a recording head which uses a surface wave interference is employed as a recording head 55, similarly to the recording head 15 of the first embodiment.

In FIG. 8, an image recording device according to the second embodiment comprises a controller 51 and a recording head 55. The controller 51 comprises a delay circuit group 56 consisting of delay circuits (1) through (8), a waveform generating circuit group 52 consisting of waveform generating circuit (1) through (8), a control circuit 53, and a switching circuit 54.

As illustrated in FIG. 8, the delay circuit group 56 consisting of the delay circuits (1) through (8) and the waveform generating circuit group 52 consisting of the waveform generating circuits (1) through (8) are included in the controller 51. Namely, eight kinds of driving waveforms are prepared to be supplied to the aforesaid piezoelectric actuator 24 also in this embodiment. Among these eight kinds of driving waveforms, one driving waveform is selectively supplied to the piezoelectric actuator 24 in the recording head 55 by switching operation of the switching circuit 54. A single sinusoidal pulse shown in FIG. 3 is used as the driving waveform also in this embodiment. The diameter of ink droplet is varied by eight grades at a range between 15 μm and 50 μm by the use of eight kinds of the driving waveforms each having a pulse width L different from each other. An essential feature of this embodiment is to control a timing for jetting an ink droplet responsive to the diameter of the ink droplet so as to prevent deviation of position of impact of the ink droplet. The delay circuit group 56 is included in the controller 51 as the timing modulation unit. The delay circuit group 56 is used for controlling a timing when a driving waveform is supplied to the recording head 55.

FIG. 9 conceptually shows a case in which positions of impact of ink droplets are deviated between a comparatively large one and a comparatively small one. FIG. 10 conceptually shows another case in which positions of impact of ink droplets are not deviated between the comparatively large one and the comparatively small one by changing a timing for jetting the ink droplets therebetween. As illustrated in FIG. 9, when the comparatively large one and the comparatively small one are jetted from the recording head 55 at the same timing and speed, large deviation of positions of impact of both ink droplets is caused to occur. Accordingly, such deviation can be prevented from being caused to occur by jetting the comparatively small one at a faster timing, as illustrated in FIG. 10.

In this embodiment, the speed of jetted ink droplets is kept approximately constant (3 m/s) in relation to all diameters of the jetted ink droplets. In addition, a moving speed of the recording head 55 is kept at 1 m/s while a flying distance of the jetted ink droplet is kept at 1 mm. Under these conditions, the deviation of about 40 μm is caused to occur, when the smallest ink droplet (15 μm) and the largest ink droplet (40 μm) are jetted from the recording head 55 at the same timing. Accordingly, the timing of jetting the largest ink droplet (40 μm) is delayed by 40 μs in this embodiment, so that positions of impact of both the smallest one and the largest one are coincided with each other.

An experiment was performed to estimate an actual image recording by the image recording device of the second embodiment. As a result, it was estimated that deviation of position of impact of ink droplets fell within 25 μm between all of the ink droplets having various diameters thereof. Thus, it was confirmed that high quality image could be obtained by the image recording device of the second embodiment.

Figure 11:
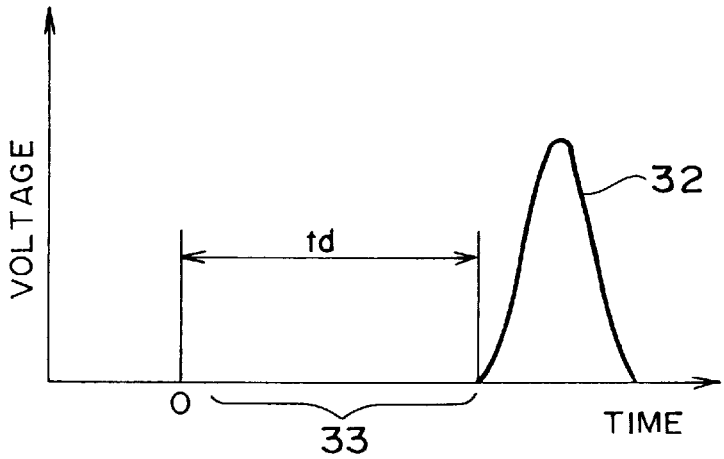
FIG. 11 is a graph for showing a driving waveform for driving a recording head in a third embodiment of the present invention.

Referring to FIG. 11, description will proceed to an image recording device according to a third embodiment of the present invention. In the aforesaid second embodiment, a timing for jetting an ink droplet was controlled by the delay circuits provided in the controller. However, the inventor has thought that a timing for jetting an ink droplet could be controlled by adding data for adjusting the timing to the driving waveform.

FIG. 11 shows an example of the driving waveform to which such data for adjusting the timing is added in this embodiment. A single sinusoidal pulse including data of delay time td for adjusting a timing is used as the driving waveform in this embodiment, as shown in FIG. 11. The diameter of ink droplet is varied by eight grades at a range between 15 μm and 50 μm by the use of eight kinds of the driving waveforms each having a pulse width L different from each other. Further, a timing for jetting the ink droplet is also varied by adding the data of delay time td for adjusting the timing to the driving waveform of the sinusoidal pulse. Besides, the image recording device of this embodiment has a structure basically similar to that of the first embodiment shown in FIG. 6.

In this embodiment, a timing for jetting an ink droplet is controlled by adding data for adjusting the timing to the sinusoidal pulse 32 on the preceding side thereof. In a case that the diameter of the ink droplet is larger, the delay time td of the data for adjusting the timing is determined to be longer. For example, the delay time td is determined to be 0 μs with respect to a driving waveform for jetting the ink droplet having the smallest diameter of 15 μm. On the other hand, the delay time td is determined to be 40 μs with respect to a driving waveform for jetting the ink droplet having the largest diameter of 50 μm. The timing for jetting the ink droplet having the largest diameter can be delayed by 40 μs compared with the timing for jetting the ink droplet having the smallest diameter. Accordingly, the waveform generating circuit group is operable as both a diameter modulating unit for modulating a diameter of the ink droplet and a speed controlling unit for controlling a speed of the ink droplet.

An experiment was performed to estimate an actual image recording by the image recording device of the third embodiment. As a result, it was estimated that deviation of position of impact of ink droplet fell within 25 μm between all of the ink droplets having various diameters thereof, similarly to the aforesaid second embodiment. However, in this embodiment, the timing for jetting an ink droplet can be controlled without using delay circuits by adding the data for adjusting the timing to the driving waveform produced from the waveform generating circuits. Therefore, the image recording device of this embodiment is advantageous in structure thereof, since the image recording device can be fabricated at a lower cost.

As described above, deviation of position of impact of ink droplet is efficiently prevented from being caused to occur in the above first through third embodiments. As a result, the deviation is not readily caused to occur, even though a moving speed of a recording head becomes higher. Accordingly, the image recording devices of the first through the third embodiments are advantageous in high speed recording, since the recording head thereof can be moved at a high speed. Similarly, the deviation is not readily caused to occur, even though a flying distance of an ink droplet becomes longer. Accordingly, the image recording devices of the first through the third embodiments are advantageous in reduction of manufacturing cost or improvement of reliability, since a distance between the recording head thereof and a recording medium can be determined to be long to some extent.

While the present invention has thus far been described in conjunction with only two embodiments thereof, it will now be readily possible for those skilled in the art to put this invention into various other manners.

For example, in the above first through third embodiments, a sinusoidal pulse was used as the driving waveform. However, the other waveforms, such as a rectangular pulse, a trapezoidal pulse, a triangular pulse, and the like may be used as the driving waveform.

Further, the recording head using surface wave interference was employed in the above first through third embodiments. However, the present invention can also be applied when a recording head uses the other principles for jetting the ink droplet, such as a system using a boiling phenomenon of ink, a system for directly jetting an ink droplet by a pressure wave produced by a piezoelectric actuator, a system using an electrostatic absorption of ink, or the like.

In addition, modulations of a diameter and a speed of ink droplet were carried out by controlling pulse width and pulse amplitude of the driving waveform. However, the modulations of the diameter and the speed of ink droplet can be carried out by controlling a rise time of a driving pulse, a generating position of a pressure wave, a diameter of an opened portion of a recording head, a shape of a pressure chamber of a recording head.

Moreover, in the second embodiment, the speed of jetted ink droplets was kept approximately constant in relation to all diameters of the jetted ink droplets, as mentioned before. However, it is not necessary that the speed of jetted ink droplets is kept constant. When the speed of jetted ink droplets is not constant, each speed of the ink droplet having each diameter should be actually measured. Based on the result of the measurement, a timing for jetting the ink droplets each having a respective diameter may be controlled.

What is claimed is:

1. An image recording device which records an image on a recording medium responsive to a desired gradation in each pixel, comprising:

a recording head for jetting an ink droplet having a diameter at a speed therefrom;

diameter modulating means for modulating said diameter of said ink droplet in response to said desired gradation in each pixel; and speed modulating means for modulating said speed dependent on said diameter of said ink droplet.

2. An image recording device as claimed in claim 1, further comprising control means for controlling each operation of said diameter modulating means and said speed modulating means, wherein said diameter and said speed are managed and arranged by said control means.

3. An image recording device as claimed in claim 1, comprising pulse generating means for generating a pulse which drives said recording head to jet said ink droplet, wherein said pulse generating means are operable as both said diameter modulating means and said speed modulating means.

4. An image recording device as claimed in claim 1, wherein said diameter comprises a first diameter and a second diameter smaller than said first diameter, said speed comprising a first speed and a second speed higher than said first speed, said speed being determined to be said first speed or said second speed when said diameter is determined to be said first diameter or said second diameter, respectively.

5. An image recording device as claimed in claim 3, wherein said diameter is modulated by a pulse width modulation of said pulse generated from said pulse generating means.

6. An image recording device as claimed in claim 3, wherein said speed is modulated by a pulse amplitude modulation of said pulse generated from said pulse generating means.

7. An image recording device as claimed in claim 3, wherein said diameter is modulated by a pulse width modulation of said pulse while said speed is modulated by a pulse amplitude modulation thereof.

* * * * *